US006363610B1

(12) United States Patent
Narasimhan et al.

(10) Patent No.: US 6,363,610 B1
(45) Date of Patent: Apr. 2, 2002

(54) GAS TURBINE ROTOR BIMETALLIC RING SEAL AND METHOD THEREFOR

(75) Inventors: Dave Narasimhan, Flemingtonn; Alexander S. Kozlov, Wharton, both of NJ (US); Steve H. Halfmann, Chandler, AZ (US); Mark C. Morris; Thomas E. Strangman, both of Phoenix, AZ (US)

(73) Assignee: Allied Signal, Inc., Morris Township, NJ (US)

( * ) Notice: Subject to any disclaimer, the term of this patent is extended or adjusted under 35 U.S.C. 154(b) by 0 days.

(21) Appl. No.: 09/422,587

(22) Filed: Oct. 21, 1999

(51) Int. Cl.[7] ..... B21D 53/84
(52) U.S. Cl. ..... 29/888.3; 29/527.2
(58) Field of Search ..... 29/888.3, 424, 29/527.2, 888.07, 888.074; 428/670, 936; 148/537; 277/654, 653, 650; 427/437, 405, 376.8, 376.6, 376.7

(56) References Cited

U.S. PATENT DOCUMENTS

| | | | | |
|---|---|---|---|---|
| 3,635,586 A | | 1/1972 | Kent et al. | |
| 4,021,138 A | | 5/1977 | Scalzo et al. | |
| 4,432,555 A | | 2/1984 | Langley | |
| 4,477,087 A | | 10/1984 | Sutter, Jr. et al. | |
| 4,810,591 A | | 3/1989 | Sakai | |
| 4,916,022 A | * | 4/1990 | Solfest et al. | 428/623 |
| 5,492,726 A | * | 2/1996 | Rose et al. | 428/376.8 |
| 5,843,588 A | * | 12/1998 | Rose et al. | 428/670 |
| 5,856,027 A | * | 1/1999 | Murphy | 148/537 |
| 5,891,267 A | * | 4/1999 | Schaeffer et al. | 148/537 |
| 5,942,337 A | * | 8/1999 | Rickerby et al. | 428/670 |

FOREIGN PATENT DOCUMENTS

| | | |
|---|---|---|
| JP | 80764 | 5/1984 |
| JP | 247386 | 10/1990 |

* cited by examiner

*Primary Examiner*—I Cuda Rosenbaum
*Assistant Examiner*—T. Nguyen
(74) *Attorney, Agent, or Firm*—Robert Desmond, Esq.

(57) ABSTRACT

A method for making a bimetallic ring seal having a nickel core covered by a first layer of platinum having a inner dense portion and a second outer portion both of which plastically deform in the presence of a load. The method includes the step of applying a porous layer of platinum over the dense layer by electroless plating in a platinum bath comprising 0.8–1.2 gram/liter platinum as diammine dinitrite salt $Pt(NH_3)_2(NO_2)_2$, 50–100 milliliter/liter of 25% ammonium hydroxide $NH_4OH$; and 0.3–1.5 gram/liter hydrazine hydrate $N_2H_4$—$H_2O$, at a temperature in the range of 75–90° C. and at a plating rate in the range of 0.5–3.0 micron/hour and then plastically deforming the ring seal under load.

11 Claims, 4 Drawing Sheets

GAS TURBINE ROTOR BIMETALLIC RING SEAL AND METHOD THEREFOR

TECHNICAL FIELD

This invention relates to ring seals used in gas turbine engines and methods for making such ring seals.

BACKGROUND OF THE INVENTION

A typical prior art ring seal used to seal between a seal plate and a turbine rotor in a gas turbine engine is shown in FIG. 1. Referring to this figure, a turbine rotor 10 consists of a wheel portion 12 which is coupled to other rotating components in the engine by curvic couplings 14. In a manner familiar to those skilled in the art, at its radially outer periphery 16, the rotor 10 has a plurality of circumferentially disposed fir-tree grooves. Each of these grooves receives a correspondingly shaped root of a blade 20. The outer surface of the periphery 16 disposed between adjacent blades is referred to as a disk post 18, which is shown in FIG. 2. A rotating seal plate 22 abuts the periphery 16 of the rotor 10. Two conventional ring seals 24 are used to prevent leakage between the seal plate and the rotor. These seals are typically a simple split ring of nickel and are commonly used in gas turbine engines.

The blades 20 are usually mounted in the grooves at an angle that is offset from the axial axis of the engine. This angle is referred to as a broach angle. For highly loaded turbine rotors (i.e. those subject to high stresses due to high rotational speeds), the broach angle causes a net moment on the individual disk posts which may cause the posts to twist significantly. This twisting results in a sawtooth pattern between blades and disk posts as viewed from above and circumferentially around the rotor. For illustrative purposes, this sawtooth pattern is exaggerated in FIG. 2. The actual offset between the disk post and adjacent blades typically does not exceed 0.004 inches. Referring to this figure, because of the sawtooth pattern, triangular leakage areas 26 form between seal rings and the rotor periphery. Conventional nickel rings seals are not pliable enough to deform and fill these leakage areas resulting in a performance penalty to the engine.

Accordingly, there exists a need for a seal ring that is deformable so as to be able to fill these triangular leakage areas.

SUMMARY OF THE INVENTION

An object of the present invention is to provide a deformable seal ring.

Another object of the present invention is to provide a method for making a deformable seal ring.

The present invention achieves this object by providing a ring seal having a nickel or cobalt core covered by a layer of a noble metal, preferably platinum. This layer further includes a dense inner layer and a porous outer layer both of which plastically deform in the presence of a load.

A method for making such a seal is also disclosed. The method starts with a nickel or cobalt wire ring and includes the following steps.

coating said ring with a first layer of platinum to form a dense platinum layer;

optionally heating said coated ring until said platinum and nickel diffuse together;

applying a second layer of porous platinum over said first layer by electroless plating said coated ring in a platinum bath comprising 0.8–1.2 gram/liter platinum as diammine dinitrite salt $Pt(NH_3)_2(NO_2)_2$, 50–100 milliliter/liter of 25% ammonium hydroxide $NH_4OH$; and 0.3–1.5 gram/liter hydrazine hydrate $N_2H_4H_2O$, at a temperature in the range of 75–90° C. and at a plating rate in the range of 0.5–3.0 micron/hour with the total thickness of the platinum layer being in the range of 0.002 to 0.006 inch.

heating said twice coated ring in an inert atmosphere until the included hydrogen in the porous platinum layer escapes creating a metallurgical bond between the core and the inner dense platinum layer and until the platinum is annealed, (i.e. softened);

cooling said twice coated ring and mounting said ring between said structures; and plastically deforming the ring when place under load in an engine or other application.

These and other objects, features and advantages of the present invention are specifically set forth in or will become apparent from the following detailed description of a preferred embodiment of the invention when read in conjunction with the accompanying drawings.

DESCRIPTION OF THE PREFERRED EMBODIMENT

Figure 1:
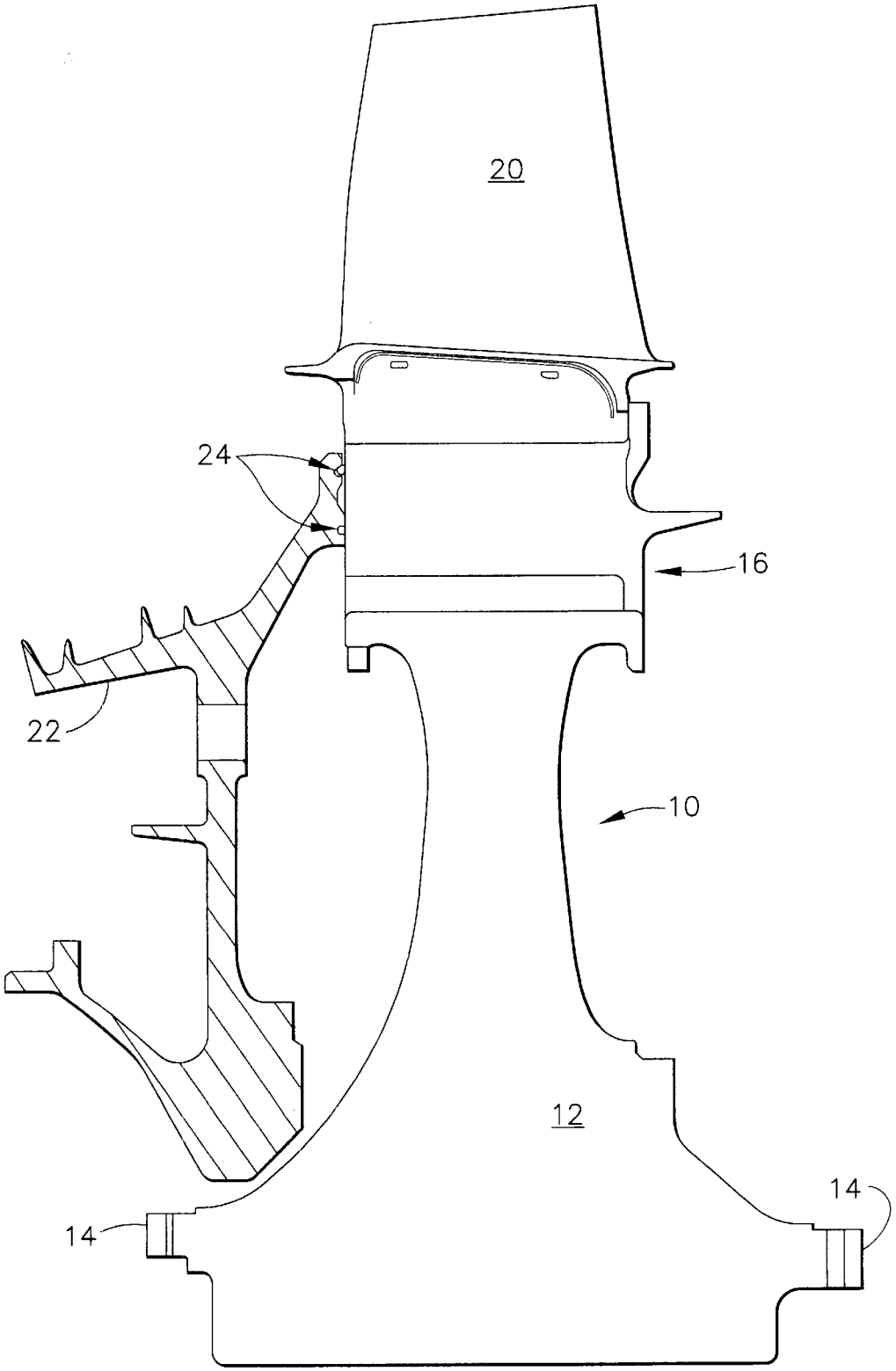
FIG. 1 (PRIOR ART)
FIG. 1 is a cross-section of a turbine disk assembly that can employ a prior art ring seal or a ring seal contemplated by the present invention.
Figure 2:
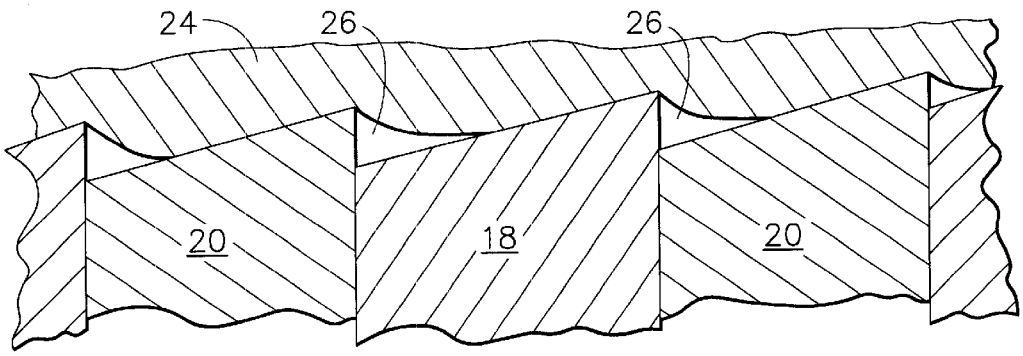
FIG. 2 (PRIOR ART)
FIG. 2 is an illustration of a partial top view of the turbine disk assembly of FIG. 1 showing a prior art ring seal during engine operation.
Figure 3:
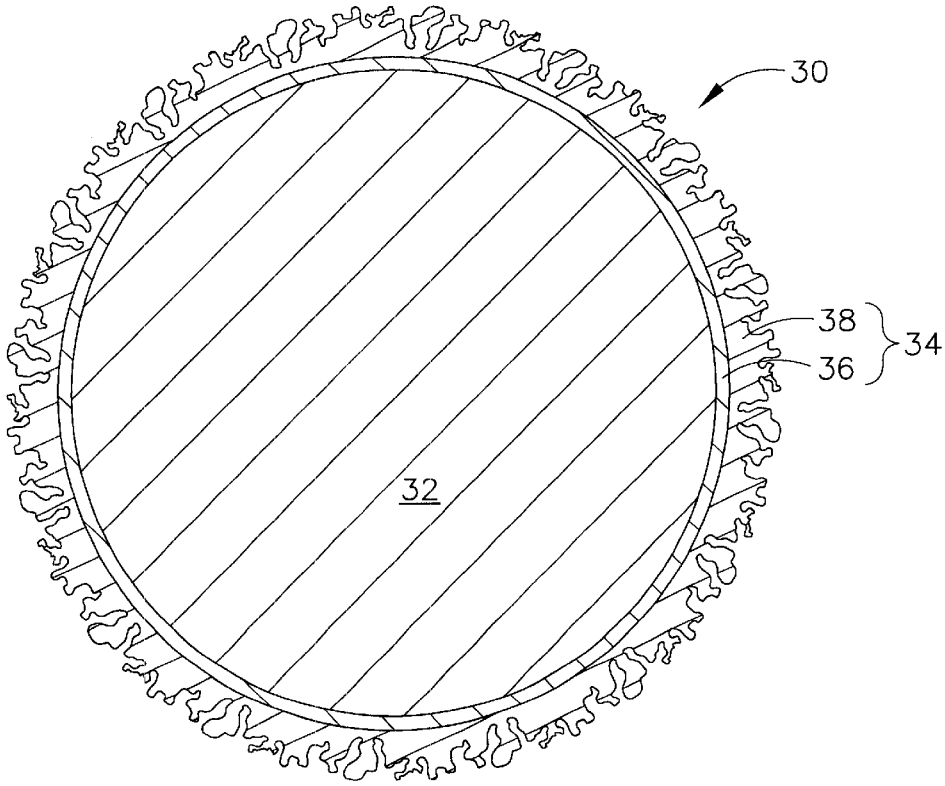
FIG. 3 is a cross-section of the ring seal contemplated by the present invention before being mounted in an engine.

FIG. 3 shows a ring seal 30 prior to being mounted in a turbine disc assembly. The seal 30 includes a nickel wire core 32 covered by a layer 34 of a noble metal with platinum being the preferred noble metal. The noble metal layer 34 includes a dense inner layer 36 and a porous outer layer 38. In the preferred embodiment, the dense layer 36 is between 6–14 percent of the thickness of the layer 34 and more preferably 10 percent of this thickness. For highly loaded turbine rotors in the engine size class of 3,000 horsepower, a preferred nickel wire core 32 diameter is about 0.040 inches and a preferred platinum layer thickness 34 is about 0.003 inches.

Figure 6:
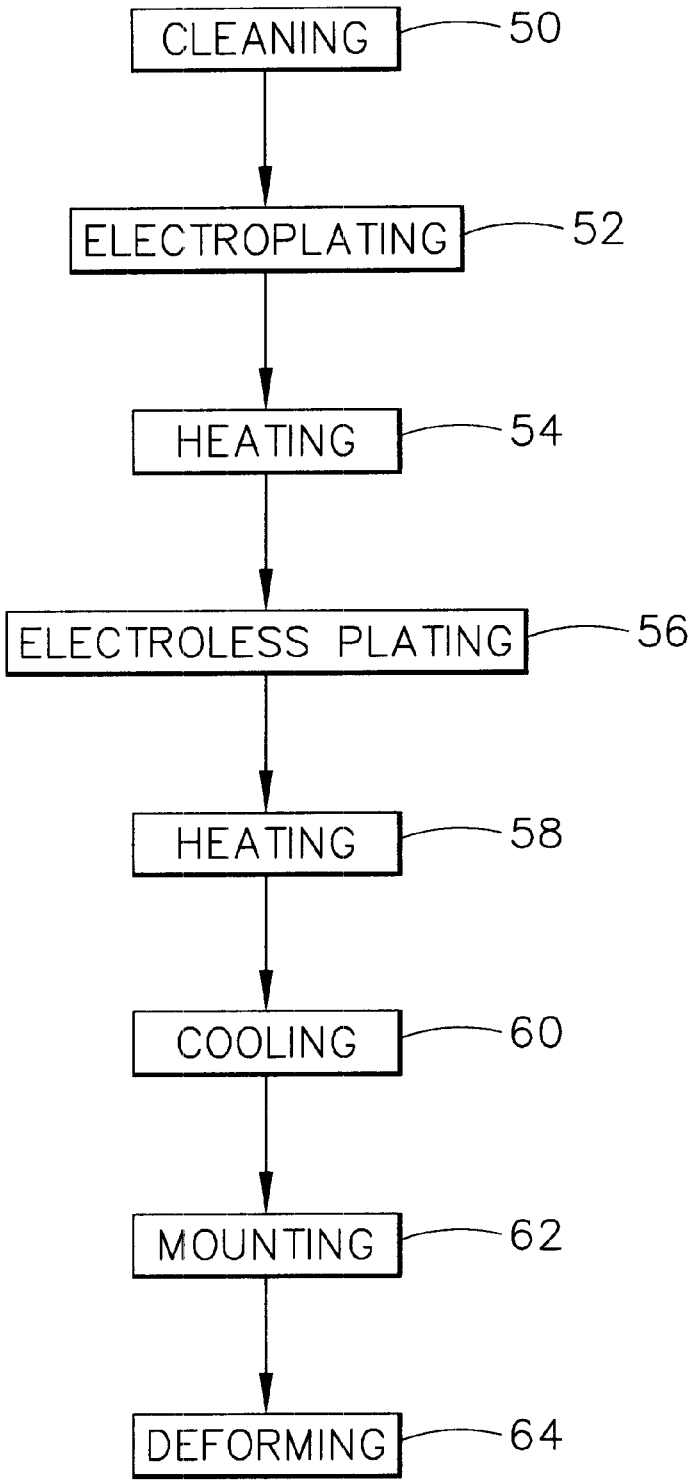
FIG. 6 is a flow chart illustrating a method for making the ring seal contemplated by the present invention.

Referring to FIG. 6, the ring seal 30 is fabricated as follows. First, a nickel wire is provided. Because nickel wire inherently is covered by an oxide layer, this layer is removed using mechanical cleaning methods familiar to those skilled in the art as well as an acid wash. (step 50). Once cleaned, a thin layer of platinum, i.e. a few microns, is applied all around the outer surface of the nickel wire by conventional electroplating methods to form the dense layer 36. (step 52). Alternatively, the platinum can be applied by electroless plating, sputtering, electron beam physical vapor deposition, or chemical vapor deposition. The coated wire is then placed in an oven and heated to 900–1000° C. for about 30 minutes. (step 54). This heating step is optional. During this heating step, the nickel diffuses into the platinum and the platinum diffuses into the nickel establishing a metallurgical bond. Next, additional porous platinum is added to the outer surface of the coated wire by electroless plating in a platinum bath. (step 56) with the total thickness of the platinum layer being in the range of 0.002 to 0.006 inch. In the preferred embodiment, the bath comprises 0.8–1.2 gram/liter platinum as diammine dinitrite salt $Pt(NH_3)_2(NO_2)_2$; 50–100 milliliter/liter of 25% ammonium hydroxide $NH_4OH$; and 0.3–1.5 gram/liter hydrazine hydrate $N_2H_4H_2O$. This step operates at a temperature in the range of 75–90° C. and at a plating rate of 0.5–3.0 micron/hour. More preferably, the bath comprises 1.0 gram/liter platinum as diammine dinitrite salt $Pt(NH_3)_2(NO_2)_2$; 50 milliliter/liter of 25% ammonium hydroxide $NH_4OH$; and 1.5 gram/liter hydrazine hydrate $N_2H_4H_2O$, with the temperature at 85° C. and a plating rate of 0.5 micron/hour at the beginning of the process and gradually increasing to 3.0 micron/hour as the surface area increases. After the electroless plating, the wire is heated in an inert atmosphere to between 900–1000° C. for about 30 minutes. (step 58). Due to the porous structure of the platinum layer, pathways are available for the included hydrogen to escape, (hydrogen outgassing), without forming disruptive hydrogen bubbles. Because bubbles do not form, the interface between the platinum and nickel is maintained without damaging the metallurgical bond.

Figure 4:
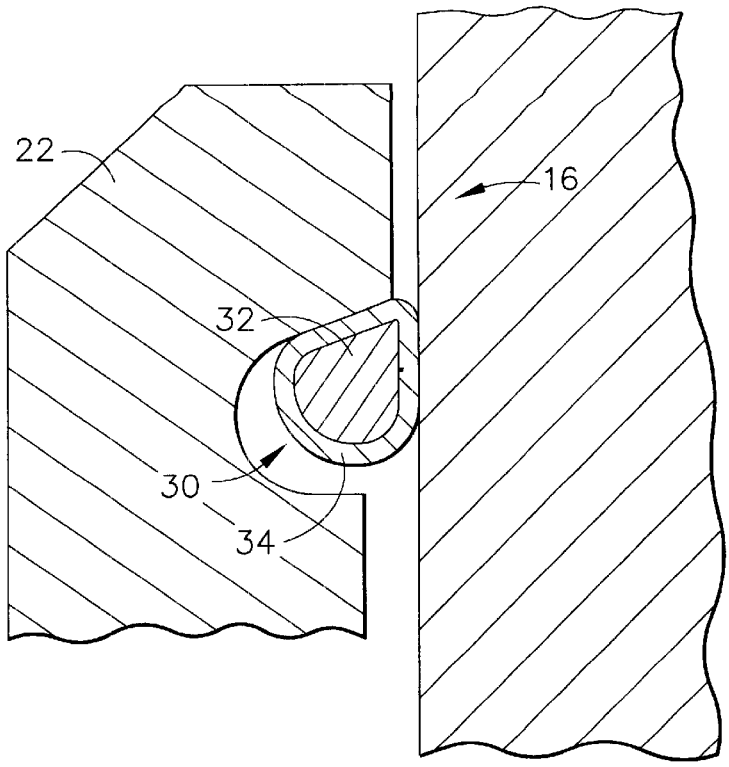
FIG. 4 is an illustration showing the ring seal of FIG. 3 after it is mounted in the turbine disc assembly of FIG. 1 and has plastically deformed during engine operation.
Figure 5:
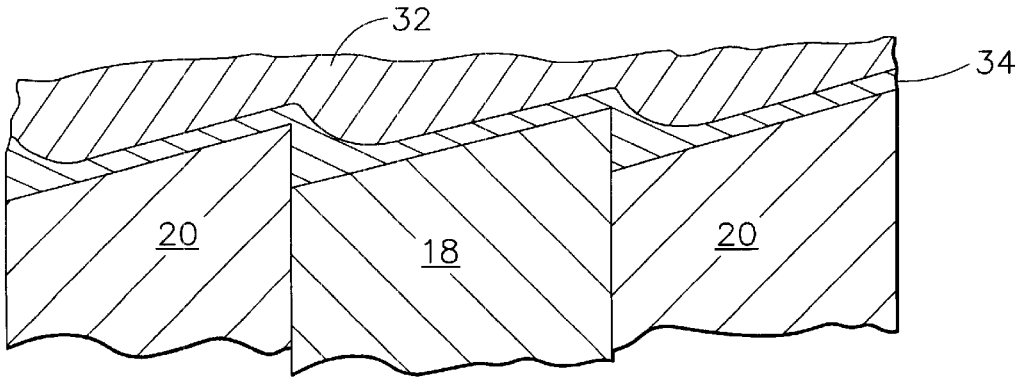
FIG. 5 is an illustration of a partial top view of the turbine disk assembly of FIG. 1 showing the ring seal contemplated by the present invention after it has plastically deformed during engine operation.

After cooling to room temperature, (step 60), the ring seal 30 is ready for the final step of being mounted in the engine between the sealing plate and the turbine disc. (step 62). With additional reference to FIGS. 4 and 5, loads associated with high speed rotation of the seal plate force the wire seal 30 up between the disk periphery 16 and seal plate 22. Importantly, the seal 30 and in particular the porous platinum layer 34, plastically deform, (step 64), to permanently seal between the disc 10 and seal plate 22. As a result, the leakage triangles 26 that occurred with prior art ring seals are filled with plastic flow of the platinum layer 38 finally forming the ring seal 30 as contemplated by the present invention.

Though the invention has been described with respect to the preferred embodiment, it should be appreciated that this description of the invention should be considered exemplary and not as limiting the scope and spirit of the invention as set forth in the following claims.

What is claimed is:

1. A method for forming a ring seal for sealing between two structures comprising the steps of:

a) providing a ring made of a material selected from a group of nickel and cobalt;

b) coating said ring with a first layer of platinum to form a dense platinum layer;

c) applying a second layer of porous platinum having a thickness between about 0.002 inches to about 0.006 inches over said first layer by electroless plating;

d) heating said twice coated ring in an inert atmosphere until the included hydrogen escapes and a metallurgical bond forms between said core and said platinum;

e) cooling said twice coated ring and mounting said ring between said structures; and f) plastically deforming the ring between said structures to form said ring seal.

2. The method of claim 1 further including between steps (b) and (c) the step of heating said coated ring in an inert atmosphere until said platinum and nickel diffuse together.

3. The method of claim 2 wherein said heating steps occur at a temperature in the range of 900–1000° C. for a period of about 30 minutes.

4. The method of claim 1 wherein in step (c) said coated ring is electroless plated in a platinum bath comprising 0.8–1.2 gram/liter platinum as diammine dinitrite salt $Pt(NH_3)_2(NO_2)_2$, 50–100 milliliter/liter of 25% ammonium hydroxide $NH_4OH$; and 0.3–1.5 gram/liter hydrazine hydrate $N_2H_4.H_2O$, at a temperature in the range of 75–90° C. and at a plating rate in the range of 0.5–3.0 micron/hour.

5. The method of claim 4 further including between steps (a) and (b) the step of cleaning said nickel wire.

6. The method of claim 4 further including in the electroless plating step, the step of varying the plating rate as the surface area increases.

7. A method for forming a ring seal for sealing between two structures comprising the steps of:

a) providing a ring made from a material selected from a group consisting of cobalt and nickel;

b) coating said ring with a first layer of platinum to form a dense platinum layer;

c) applying a second layer of porous platinum having a thickness between about 0.002 inches to about 0.006 inches over said first layer by electroless plating said coated ring in a platinum bath comprising 1.0 gram/liter platinum as diammine dinitrite salt $Pt(NH_3)_2(NO_2)_2$, 50 milliliter/liter of 25% ammonium hydroxide $NH_4OH$, and 1.5 gram/liter hydrazine hydrate $N_2H_4$—$H_2O$, with the temperature at 85° C. and a plating rate of 0.5 micron/hour at the beginning of the process and gradually increasing to 3.0 micron/hour as the surface area increases;

d) heating said twice coated ring in an inert atmosphere until the included hydrogen escapes;

e) cooling said twice coated ring and mounting said ring between said structures; and f) plastically deforming the ring between said structures to form said ring seal.

8. The method of claim 7 further including between steps (a) and (b) the step of cleaning said ring.

9. The method of claim 7 further comprising between steps (b) and (c) the step of heating said coated ring in an inert atmosphere until said platinum and nickel diffuse together.

10. The method of claim 9 wherein said heating steps occur at a temperature in the range of 900–1000° C. for a period of about 30 minutes.

11. A method for forming a ring seal for sealing between two structures comprising the steps of:

a) providing a ring made from a material selected from a group consisting of cobalt and nickel;

b) mechanically cleaning the ring such that the surface is substantially free from an oxide layer;

c) coating said ring with a first layer of platinum to form a dense platinum layer;

d) heating the coated ring in an inert atmosphere at temperature between about 900 to about 1000 degrees Celsius until the platinum and nickel diffuse together;

e) applying a second layer of porous platinum having a thickness between about 0.002 inches to about 0.006 inches over said first layer by electroless plating said coated ring in a platinum bath comprising 1.0 gram/liter platinum as diammine dinitrite salt $Pt(NH_3)_2(NO_2)_2$, 50 milliliter/liter of 25% ammonium hydroxide $NH_4OH$, and 1.5 gram/liter hydrazine hydrate $N_2H_4$—

$H_2O$, with the temperature at 85° C. and a plating rate of 0.5 micron/hour at the beginning of the process and gradually increasing to 3.0 micron/hour as the surface area increases;

f) heating said twice coated ring in an inert atmosphere until the included hydrogen escapes;

g) cooling said twice coated ring and mounting said ring between said structures; and h) plastically deforming the ring between said structures to form said ring seal.

* * * * *